US006155562A

United States Patent [19]

Pollock et al.

[11] Patent Number: 6,155,562

[45] Date of Patent: Dec. 5, 2000

[54] METHOD AND APPARATUS FOR DIVERTING AND SEPARATING SHEETS OF A PRINTABLE MEDIUM

[75] Inventors: David Clarke Pollock, Somersworth; Kevin Lauren Cote, Durham; Richard Daniel Curley, Dover, all of N.H.

[73] Assignee: Heidelberger Druckmaschinen AG, Germany

[21] Appl. No.: 09/317,635

[22] Filed: May 25, 1999

[51] Int. Cl.[7] ..... B65H 29/00

[52] U.S. Cl. ..... 271/279; 271/300

[58] Field of Search ..... 271/225, 184, 271/279, 287, 299, 300

[56] References Cited

U.S. PATENT DOCUMENTS 5,188,355 2/1993 Lowell et al. ..... 271/184 X 5,855,153 1/1999 Cote et al. .

OTHER PUBLICATIONS

"Baldwin Stobb PowerTurn 260™", Baldwin Stobb of San Bernardino, CA, Aug. 1997, 2 pgs.

*Primary Examiner*—David H. Bollinger

*Attorney, Agent, or Firm*—Burns, Doane, Swecker & Mathis L.L.P.

[57] ABSTRACT

The present invention is directed to providing a method and apparatus for diverting and separating sheets of printable material, such as signatures severed from a web, in a cost effective, efficient manner which does not create the potential for damage to the signatures or jamming of the press. Exemplary embodiments can implement a signature diversion and separating in a single step, without reorienting the signatures. Thus, for example, where the signatures include a folded edge, the orientation of that folded edge can be maintained throughout the diverting and separating process.

17 Claims, 4 Drawing Sheets

METHOD AND APPARATUS FOR DIVERTING AND SEPARATING SHEETS OF A PRINTABLE MEDIUM

BACKGROUND OF THE INVENTION

1. Field of the Invention

The present invention generally relates to diverting sheets of a printable material, such as signatures severed from a web in, for example, a rotary offset printing press.

2. State of the Art

Devices for diverting signatures are known. For example, signature diverters are used to divert successive signatures in an incoming signature stream into two or more output streams. Signature diverters are used when, for example, downstream processing systems cannot operate at the speed of the incoming signature stream. In this case, two parallel downstream processing units can be configured to receive alternate ones of the incoming signatures, such that they can be operated at half the speed of the incoming signature stream.

Diverters are also used where successive signatures in an incoming signature stream contain alternating images. This occurs when, for example, the printing of a web of material is performed with a print cylinder that prints two different images on signatures during each rotation (that is, two around print cylinders). In this case, when the signatures are severed from the web, every other signature contains one of two different images, in alternating fashion. It is often desired to shift every other one of the signatures output from the print cylinder into one of two downstream signature streams in alternating fashion. That is, where the print cylinder imparts an "A" image to one signature, and a "B" image to a succeeding image, it is often desirable to divert the severed signatures into a stream of only A signatures and into a separate stream of only B signatures.

Conventional signature diverters have been implemented using bump turns. A conventional bump turn involves transporting a signature into a wall to change a velocity vector of the signature (i.e., speed and direction of the signature) into a new velocity vector instantaneously. However, in actuality, frictional forces prevent an instantaneous transition of the signature from an original velocity vector to a new velocity vector, such that conventional bump turns suffer significant disadvantages. Among the disadvantages are their unreliability in initiating a new velocity vector, the potential damage they cause to the signatures, and the potential jamming of the press which can result. In addition, conventional bump turns cannot be used to separate "A" signatures from "B" signatures. Rather, a separate downstream splitter device must be used to separate the signature stream into multiple substreams.

Accordingly, it would be desirable to provide a method and apparatus for diverting and separating signatures in a cost effective, efficient manner which does not require the use of independent diverter and stream splitter devices, and which does not result in potential damage to the signatures or jamming of the press.

SUMMARY OF THE INVENTION

The present invention is directed to providing a method and apparatus for diverting and separating sheets of printable material, such as signatures severed from a web, in a cost effective, efficient manner which does not create the potential for damage to the signatures or jamming of the press. Exemplary embodiments can implement a signature diversion and separating in a single step, without reorienting the signatures. Thus, for example, where the signatures include a folded edge, the orientation of that folded edge can be maintained throughout the diverting and separating process.

Generally speaking, exemplary embodiments are directed to a method and apparatus for diverting sheets of printable material comprising: at least one stage for feeding plural sheets of printable material with a first velocity vector; and at least one additional stage for actively imparting a second velocity vector to one of said plural sheets, and a third velocity vector, different from said second velocity vector, to a succeeding one of said plural sheets, said additional stage including at least one drive device having at least one predetermined area for contacting said printable material. In accordance with exemplary embodiments, the first and third velocity vectors can be equal.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1:
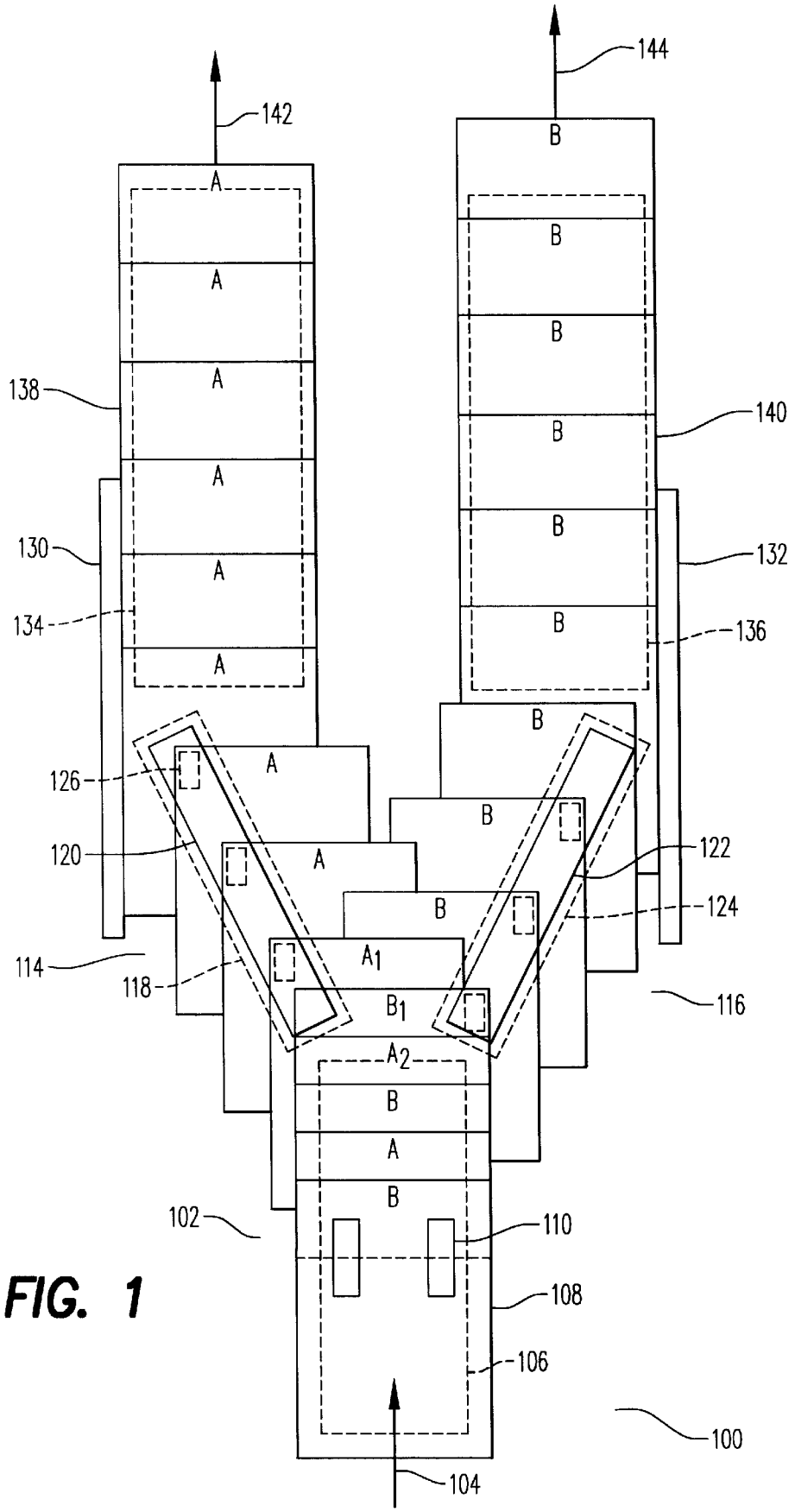
FIG. 1 shows an exemplary embodiment of a signature diverter and separator in accordance with the present invention.

FIG. 1 shows an exemplary apparatus 100 for diverting sheets of a printable material, such as a stream of signatures in a web fed rotary printing press. At least one stage, represented as a first feed stage 102, is provided for feeding signatures with a first velocity vector in a direction designated by arrow 104. The first feed stage 102 includes a lower infeed transport belt 106 for supporting a shingled stream of incoming signatures 108. The signatures are secured on the transport belt 106 by nip belts or rollers 110 or any other similar device. Of course, any known signature transport configuration can be used, provided it can be configured to operate with a signature diverter stage 112 in accordance with the present invention.

That is, signatures are transported from the feed stage 102 into at least one additional stage, represented in FIG. 1 as the second diverter stage 112, for imparting a second velocity vector to one of said plural sheets and a third velocity vector, different from said second velocity vector, to a succeeding one of said plural sheets. The diverter stage 112 includes at least two separate drive devices, each having at least one predetermined area, for contacting the signatures. In the exemplary FIG. 1 embodiment, the diverter stage includes a first drive device 114 and a second drive device 116 for diverting and separating the sheets. The first drive device 114 includes at least one upper belt 120 having at least one predetermined area for contacting a signature. The first drive device 114 also includes a lower transport belt 118. The second drive device 116 similarly includes an upper belt 122 and a lower transport belt 124.

Those skilled in the art will appreciate that exemplary embodiments of the present invention, although configured with first and second drive devices having a single upper belt, any number of belts, configured with any desired width or length can be used. For example, rather than using a single belt within each drive device, two belts can be used to enhance the torque with which a signature is diverted from the direction of the arrow 104. In addition, although the first and second drive devices are shown as transport stages angled at approximately 30° with respect to the direction of arrow 104, any desired angle can be used, and the angles for the first and second drive devices need not be the same. As those skilled in the art will appreciate, it is only necessary to provide a sufficient angle for the predetermined areas of the drive devices to contact alternating signatures from the incoming signature stream in a manner as described herein to divert and separate the signatures. In addition, those skilled in the art will appreciate that the lengths of the first and second drive devices are by way of example only, and any number of signatures can be included in the diversion path at any given time. For example, rather than having a length for establishing a diversion path that is three signatures wide, each of the drive devices 114 and 116 can be configured to establish a diversion path that is a single signature wide, or any number of signatures wide.

The drive devices can be driven in any conventional manner. For example, the upper and lower belts of each drive device can be configured to be driven in synchronism with the press, and for this purpose, can be configured as a conventional synchronous drive belt of a press, modified to include the predetermined areas to be described herein. For example, the drive belts can be configured as toothed belts, driven by a press gear which is operated in synchronism with the press. Of course, exemplary embodiments are not limited to such a drive configuration. For example, rather than using belts with teeth driven by one or more gears, the belts can be operated by a shaftless motor which, through the use of a feedback loop, is operated in synchronism with the press. Those skilled in the art will appreciate that although a common synchronous drive can be provided with respect to the upper belts 120 and 122, each of these belts can, of course, be driven independently, provided they are driven in synchronism with one another and the feed stage 102. It is only important that the predetermined areas of the upper belts be maintained in synchronism with one another and with the feed stage so that they contact signatures output from the feed stage 102 at the desired time.

In accordance with exemplary embodiments, the upper belts can be configured in a manner similar to that described in commonly assigned U.S. application Ser. No. 09/317,687, filed on even date herewith, and entitled "Method and Apparatus For Reorienting A Printable Medium" and in commonly assigned U.S. Pat. No. 5,855,153, the contents of which are hereby incorporated by reference in their entireties.

The predetermined areas which contact signatures output from the feed stage 102 are represented in the FIG. 1 embodiment as raised portions referred to herein as cleats, or lugs, 126. Other embodiments of diverters developed by the present assignee have used cleats or lugs, such as those described in copending U.S. application Ser. No. 09/020,644, filed Feb. 9, 1998 and entitled "Signature Diverting Device and Method" listing the same inventors as in the present application and incorporated herein by reference in its entirety. However, the predetermined areas used in conjunction with the first and second drive devices of the present invention are configured in drive devices which avoid any need for reorienting signatures 108 prior to their diversion and separation by the first and second drive devices. In addition, exemplary embodiments of the present invention can divert each successive signature into a different path such that successful "A" and "B" signatures can be simultaneously separated into substreams of only "A" signatures and only "B" signatures.

As in the case with the copending applications mentioned above, the lugs protrude from the belts in a direction towards the signatures, and constitute the only portions of the belts which contact the signature. The lugs can be formed integrally with their respective upper belt, or can be formed as separate components which are then attached (e.g., glued) to the belts. Although exemplary embodiments described herein show the lugs being affixed to the "upper" belts, those skilled in the art will appreciate that in some configurations, it would be desirable to affix lugs on the lower belts in place of, or in addition to, fixation of the lugs on the upper belts.

Those skilled in the art will appreciate that any materials can be used for the belts and lugs including, but not limited to, urethane, rubber or any other suitable material which can provide an adequate coefficient of friction. That is, any material which can establish an adequate coefficient of friction sufficient to divert signatures output from the feed stage 102 can be used, and should be selected based on a particular application (e.g., speed of operation, materials selected for the printable medium and so forth).

The number of lugs included on the respective belts can be adjusted accordingly, depending on the particular application as a function of, for example, the number of signatures to be diverted at any given time as well as space requirements. The number of lugs per belt associated with each signature to be diverted can also be adjusted as desired. In the FIG. 1 embodiment, each of the upper belts 120 and 122 includes one lug per signature. However, each lug could be configured as a plurality of smaller lugs, or as any protrusion(s) for establishing a desired coefficient of friction between the lug and the signature.

In contrast to the signature diverter described in the copending U.S. application Ser. No. 09/020,644, the first and second drive devices are configured such that they receive the signatures 108 from the feed stage with a first velocity vector, and then impart a second velocity vector to one of the signatures and a third velocity vector, different from the second velocity vector, to a succeeding one of the signature, rather than diverting two or more signatures at a time with the same velocity vector. For example, referring to FIG. 1, the first drive device 114 can be seen to have just diverted the signature labeled "$A_1$" while simultaneously, the second drive device 116 includes a lug which has been placed over a target area of the next succeeding signature labeled "$B_1$". It is important that the lugs of the first drive device 114 and the lugs of the second drive device 116 be offset with respect to each other relative to the leading edges of the signatures in the incoming signature stream. This permits the first drive device 114 to divert signature $A_1$ to the left hand side of FIG. 1, thereby creating a target area in the upper right hand corner of signature $B_1$ close to its leading edge, where the second drive device 116 can contact signature $B_1$ and pinch it against the lower transport belt 124 without pinching the signature $A_1$ or the succeeding signature $A_2$. As a result, the second drive device 116 can divert signature $B_1$ with a velocity vector that is different from that associated with the first drive device in its diversion of signature of the preceding signature $A_1$. This process is repeatedly implemented to alternately divert the signatures $A_n$ and $B_n$ with different velocity vectors.

Thus, the first and second drive devices of the exemplary FIG. 1 embodiment achieve a separation of the "A" and "B" signatures by changing the velocity vector of signature travel, without reorienting the signatures, using raised lugs which nip the "A" and "B" signatures to a respective angled belt at a required interval. If it is desired to realign lateral edges of the signatures for downstream processing, signature edge registration can be facilitated with edge guides 130 and 132 of the first and second drive devices, respectively. In the exemplary FIG. 1 embodiment, downstream transport is provided by lower exit transport belts 134 and 136 for each of the separated streams of signatures labeled 138 and 140, respectively. Those skilled in the art will appreciate that any type of edge registration feature can be used, such as a fixed edge guide, or an edge guide which moves with the signatures, such as belts or pulleys with vertically oriented axes.

As a result of the diversion of "A" and "B" signatures into separated streams, each of the "A" signatures has a resultant velocity vector designated 142 and each of the "B" signatures has a velocity vector designed 144. Although the velocity vectors 142 and 144 are shown to be parallel with the incoming velocity vector 104, those skilled in the art will appreciate that one of the velocity vectors 142 or 144 can be configured to be in line with, and therefore equal to, the incoming velocity vector 104. Alternately, the outgoing velocity vectors 142 and 144 can be selected to have any orientation relative to the incoming velocity vector 104.

In addition, those skilled in the art will appreciate that the signatures processed in accordance with exemplary embodiments of the present invention can be folded or unfolded signatures. For example, each of the "A" and "B" signatures can be folded on one side. The folded side can be a lateral side, a leading edge or a trailing edge of the signature.

Those skilled in the art will appreciate that the relationship between the instantaneous position of lugs on the upper belt 120 verses the instantaneous position of the lugs on the upper belt 122 can be varied as desired. In the exemplary embodiment shown, lugs of the upper belt 120 are phased (that is, offset) by a predetermined angle (for example, 180° in FIG. 1) relative to those of the upper belt 122 (as measured relative to the leading edge of signatures in the signature stream 108). However, any amount of phase offset between the lugs of the belts 120 and 122 can be used, provided a satisfactory target area on a succeeding signature can be exposed and gripped between a lug and its associated lower belt 118 or 124.

Those skilled in the art will appreciate that although the exit transport belts 134 and 136 can be operated without associated rollers or belts, additional rollers and/or belts and/or guides can be used to improve the transfer of the diverted "A" and "B" streams. Stream alignment mechanisms, such as joggers, can also be used to refine the alignment of the exiting streams.

Figure 2:
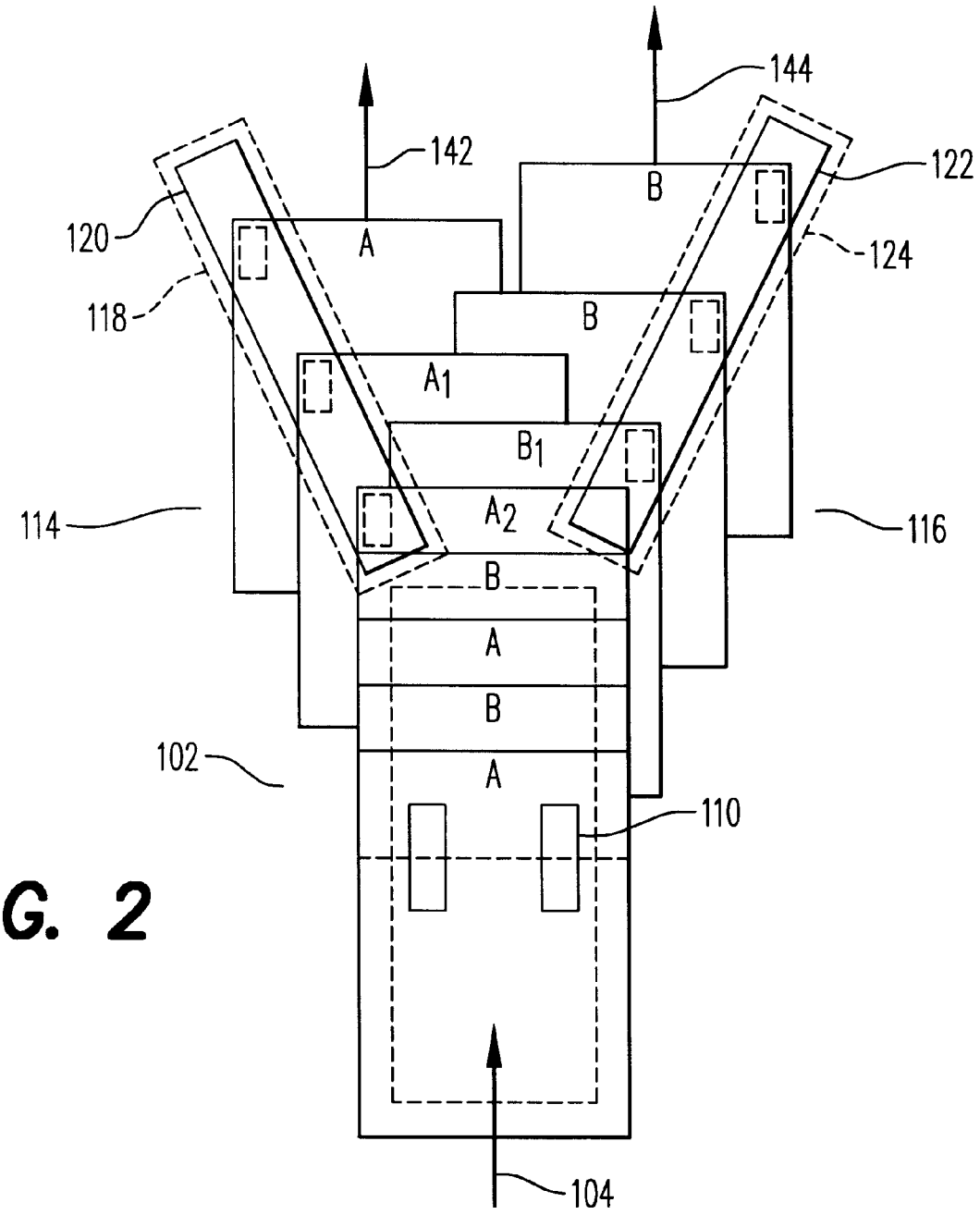
FIG. 2 shows a portion of the FIG. 1 embodiment, one cycle later.

FIG. 2 shows a signature diversion cycle subsequent to the cycle illustrated in FIG. 1. In FIG. 2, the signature $B_1$ has been diverted into the right hand side stream, thereby exposing an upper left hand corner of the succeeding signature $A_2$ for instantaneous gripping by the next sequential lug of the upper belt 120. In exemplary embodiments, at an instant where a preceding signature has been nipped between a lug and lower belt, and guided diagonally away from the incoming signature stream, the next sequential lug of the other upper belt contacts a target area on the next succeeding signature to divert it.

Figure 3:
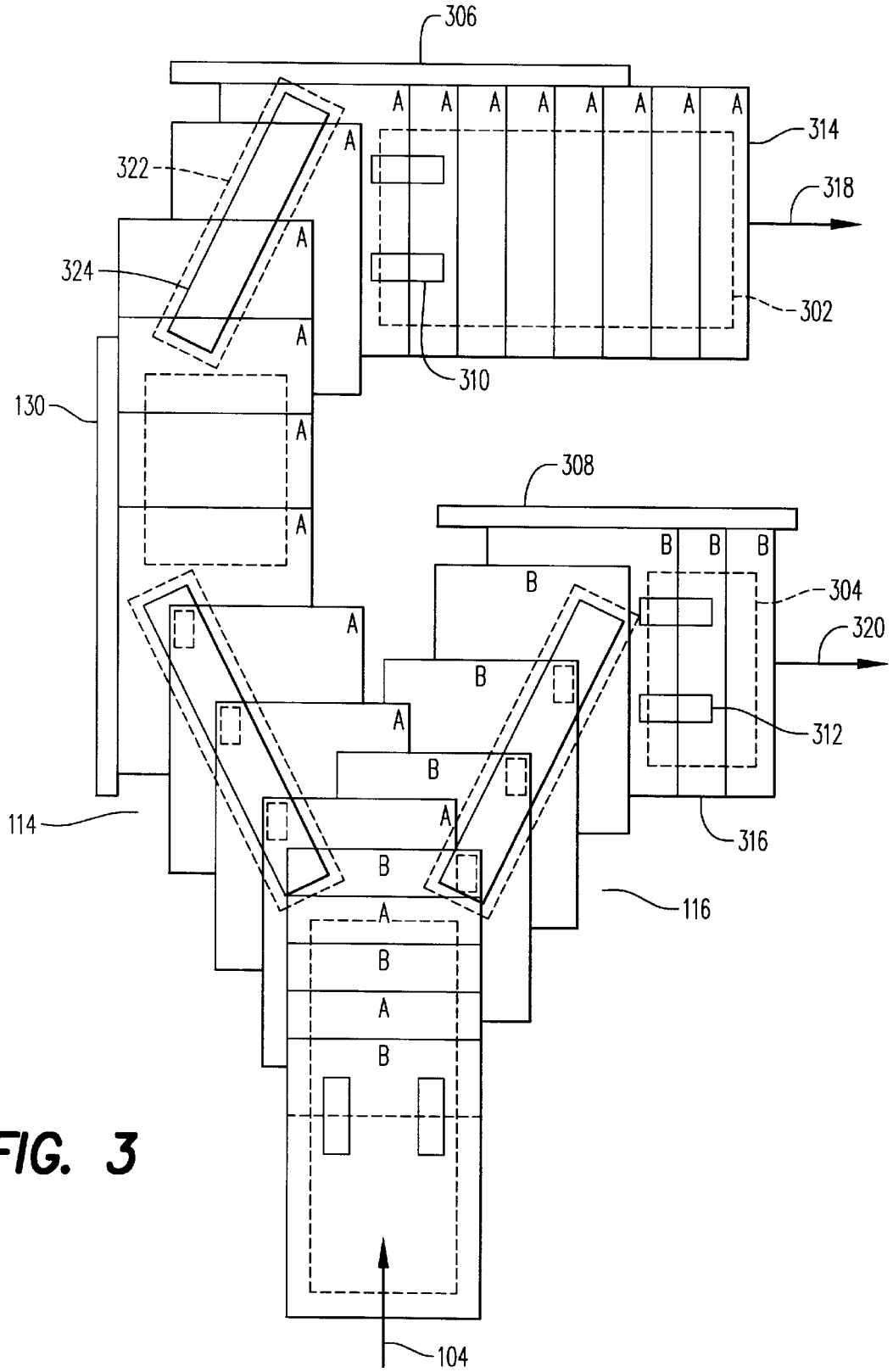
FIG. 3 shows an alternate embodiment of the present invention wherein diverted signatures are reoriented downstream.

Those skilled in the art will appreciate that in addition to diverting signatures in the manner described with respect to FIGS. 1 and 2, additional downstream processing can be used to, for example, reorient either or both of the diverted shingled streams. For example, FIG. 3 illustrates an exemplary embodiment wherein the separated streams are reoriented a second time by lower exit transport belts 302 and 304, respectively. In the exemplary FIG. 3 embodiment, the lower exit transport belts 302 and 304 operate at a 90° angle with respect to the incoming integrated signature stream direction represented by arrow 104. The reorientation, and an optional alignment of the diverted streams can be aided by optional edge guides 306 and 308, respectively, and/or by top rollers or belts 310 and 312 respectively, to provide aligned, separated output signatures streams 314 and 316, respectively, having velocity vectors designated by arrows 318 and 320. An optional angled lower belt 322 and associated upper belt 324 can be used to transport the separated signature stream from the initial diversion stage to the reorientation stage.

Figure 4:
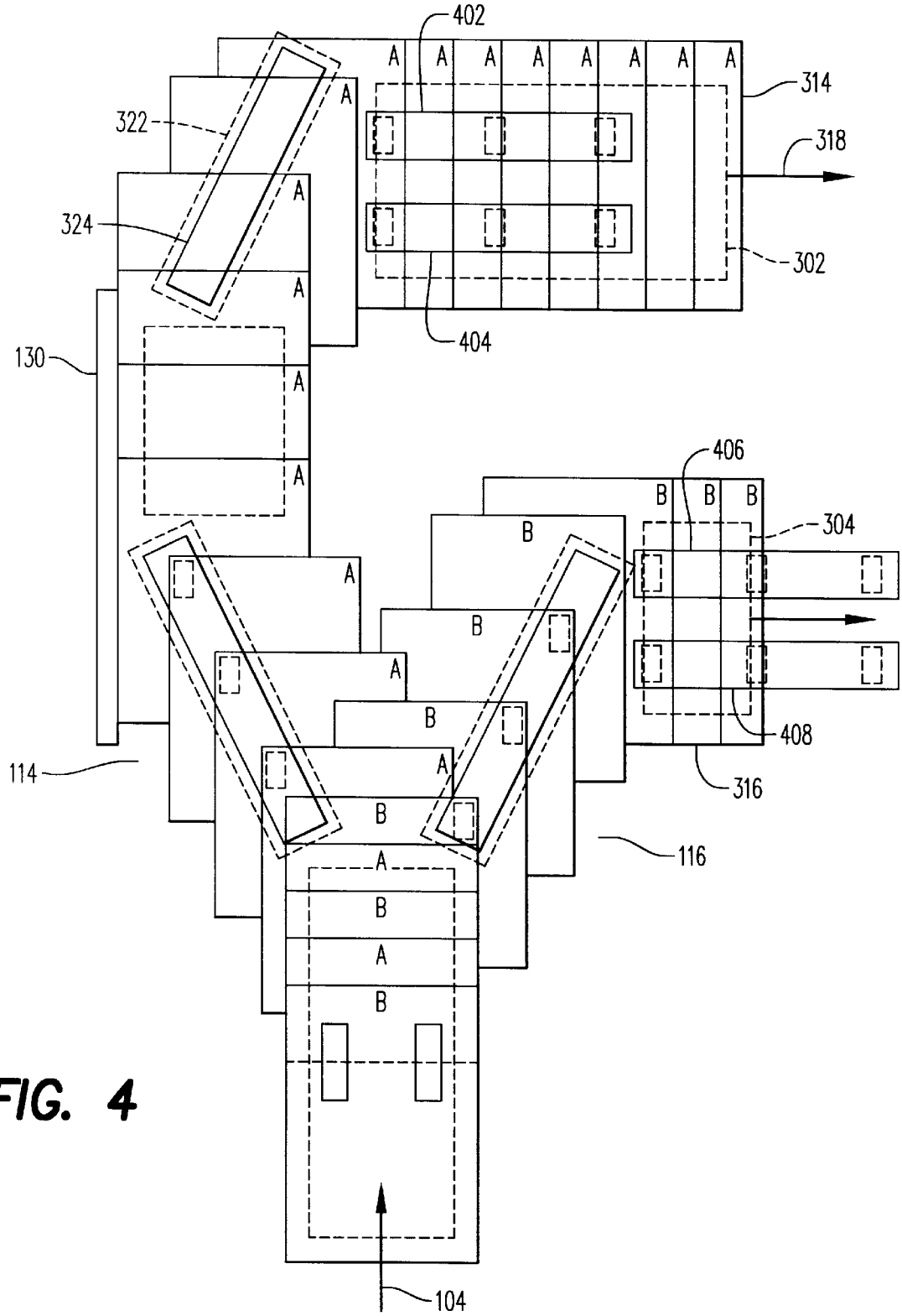
FIG. 4 shows an alternate embodiment for reorienting the signatures downstream of the signature diversion and separation operation.

FIG. 4 shows yet a further exemplary embodiment of downstream processing, wherein the reorientation stages of the FIG. 3 embodiment have been modified to include the use of rollers and/or belts having lugs thereon, in a manner similar to that described with respect to the upper belts 120 and 122. More particularly, upper lugged belts 402 and 404 are associated with the reorientation of the "A" signature stream, and upper lugged belts 406 and 408 are associated with the reorientation of the "B" diverted signatures. In the FIG. 4 embodiment, the optional edge guides 306 and 308 have therefore been eliminated to further reduce the potential for damage to the signatures and/or jamming of the press.

In addition, those skilled in the art will appreciate that a pitch correction feature similar to that described in the aforementioned copending application entitled "Method and Apparatus for Reorienting A Printable Medium" can be used in conjunction with exemplary embodiments of the present invention. For example, referring to FIG. 4, the diverted "A" signature stream can be supplied to the reorientation stage via the use of a lugged belt. That is, the upper belt 324 which transfers the "A" signatures to the exit reorientation stage can be configured with lugs. Alternately, a roller with lugs in a manner as described in the copending application can be used. As a result, pitch variations between succeeding "A" signatures can be corrected. The output "A" signature stream can be supplied via the belts 402 and 404 to a downstream realignment stage which includes, for example, paddles or other edge alignment mechanisms to realign the pitch corrected signatures. Of course, those skilled in the art will appreciate that any number of drive devices can be used in conjunction with exemplary embodiments of the present invention to repeatedly divert and separate signatures and/or reorient signatures into substreams having any desired velocity vectors.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. Apparatus for diverting sheets of printable material comprising at least one stage for feeding a first set of plural sheets and a second set of plural sheets of printable material with a first velocity vector; and at least one additional stage for actively imparting a second velocity vector to said first set of plural sheets and a third velocity vector, different from said second velocity vector, to said second set of plural sheets, said additional stage including at least one drive device having at least one predetermined area for contacting said printable material.

2. Apparatus according to claim 1, wherein said at least one stage includes at least one transport belt for delivering a shingled stream of signatures to said additional stage.

3. Apparatus according to claim 2, wherein said at least one drive device includes at least one belt for transporting said printable material in synchronism with said one stage.

4. Apparatus according to claim 1, wherein said at least one drive device includes at least one belt for transporting said printable material in synchronism with said one stage.

5. Apparatus according to claim 4, wherein said additional stage includes:

at least two upper belts, each having at least one raised portion in said at least one predetermined area for contacting printable material output from said one stage.

6. Apparatus according to claim 5, wherein said at least one additional stage comprises:

an angled transport stage which includes said at least one drive device for transporting said printable material at an angle relative to said first velocity vector; and an exit stage for transporting said printable material at a second angle relative to a transport direction of said angled transport stage.

7. Apparatus according to claim 6, wherein said second angle is the complement of said first angle.

8. Apparatus according to claim 5, wherein one of said two upper belts is oriented at a first angle with respect to said first velocity vector, the other of said two upper belts is oriented at a second angle with respect to said first velocity vector, and raised portions of said one upper belt are offset by a predetermined angle with respect to raised portions of said other upper belt.

9. Apparatus according to claim 8, wherein said predetermined angle is 180°.

10. Apparatus according to claim 1, wherein said at least one drive device is driven in synchronism with said one stage to correct variations in pitch between signatures fed from said at least one stage.

11. Apparatus according to claim 1, wherein said at least one drive device includes:

a roller configured with raised portions in said predetermined are a for contacting said printable material.

12. Apparatus according to claim 1, wherein said first velocity vector and said third velocity vector are equal.

13. Method for diverting sheets of printable material in a web fed rotary printing press, comprising the steps of:

feeding a first set of plural sheets and a second set of plural sheets of said printable material with a first velocity vector; and actively imparting a second velocity vector to said first set of plural sheets and a third velocity vector, different from said second velocity vector, to said second set of plural sheets, using at least one drive device having at least one predetermined area for contacting said printable material.

14. Method according to claim 13, wherein said steps of feeding and actively imparting are performed in synchronism.

15. Method according to claim 13, wherein said step of actively imparting includes:

correcting pitch between signatures fed as said printable material.

16. Method according to claim 13, wherein said step of actively imparting includes a step of:

transporting alternate sheets of said printable material with said second velocity vector at a predetermined angle with respect to said first velocity vector and said third velocity vector.

17. Method according to claim 16, comprising a step of:

reorienting sheets imparted with one of said second and said third velocity vectors.

* * * * *